US007150505B2

(12) United States Patent
Sollami

(10) Patent No.: US 7,150,505 B2
(45) Date of Patent: Dec. 19, 2006

(54) RETAINER SLEEVE AND WEAR RING FOR A ROTATABLE TOOL

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

(21) Appl. No.: 11/011,535

(22) Filed: Dec. 14, 2004

(65) Prior Publication Data

US 2006/0125307 A1 Jun. 15, 2006

(51) Int. Cl.
*E21C 35/197* (2006.01)

(52) U.S. Cl. ..... 299/104; 299/107

(58) Field of Classification Search ..... 299/102–107, 299/110–111

See application file for complete search history.

(56) References Cited

U.S. PATENT DOCUMENTS 4,310,939 A 1/1982 Iijima
4,489,986 A 12/1984 Dziak
4,818,027 A 4/1989 Simon
4,844,550 A 7/1989 Beebe
5,931,542 A 8/1999 Britzke
6,508,516 B1 1/2003 Kammerer
6,692,083 B1 2/2004 Latham
6,824,225 B1 11/2004 Stiffler
2006/0033379 A1 * 2/2006 Frear ..... 299/107

* cited by examiner

*Primary Examiner*—Sunil Singh
(74) *Attorney, Agent, or Firm*—Robert L. Marsh

(57) ABSTRACT

A rotatable tool has a cylindrical shank and a compressible sleeve fitted thereon to retain the shank in the bore of a tool holder. A wear ring is positioned behind the forward cutting end of the tool and against the forward surface of the tool holder. The compressible sleeve is locked to the wear ring to prevent rotation of the wear ring with the tool. Also, the outer diameter of the wear ring is greater than the width of the forward surface of the tool holder forming an overhang, and a second tool can then be used to engage the overhang to remove the tool from the tool holder.

12 Claims, 5 Drawing Sheets

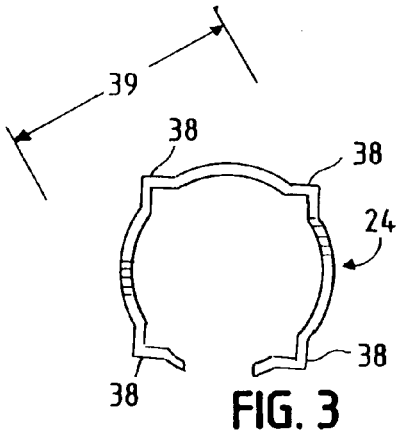
FIG. 3
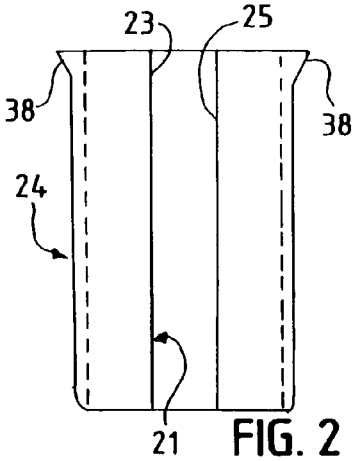
FIG. 2
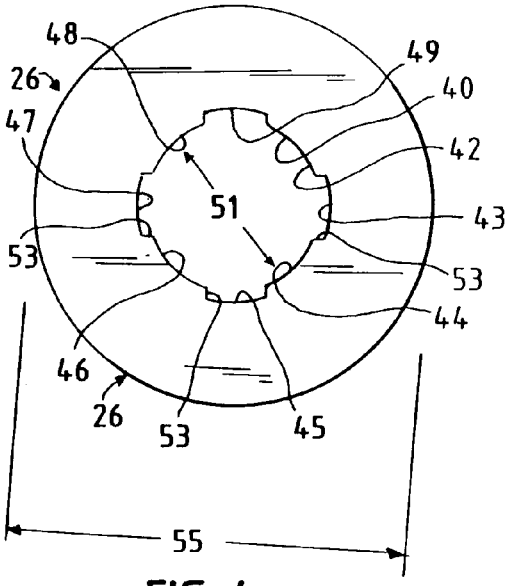
FIG. 4
FIG. 5
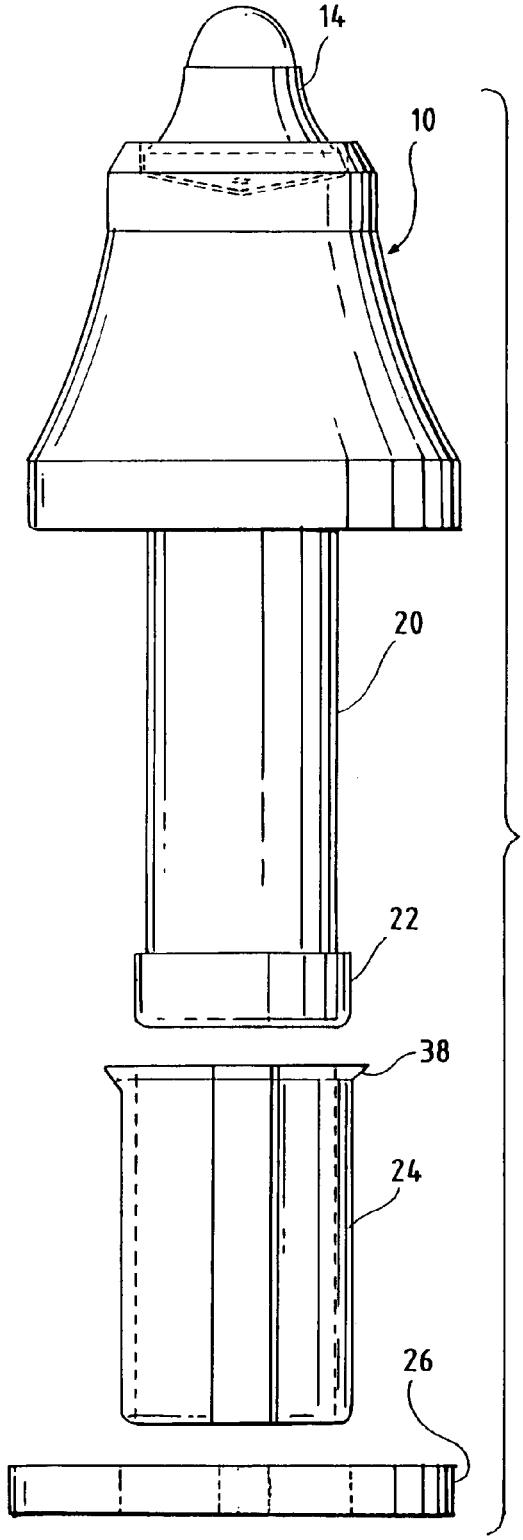

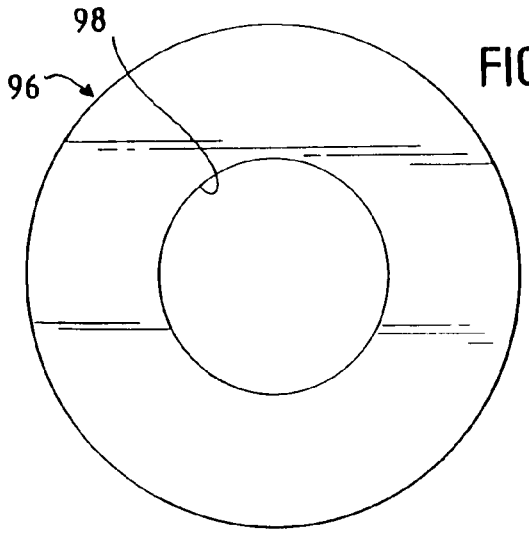
FIG. 14
FIG. 15
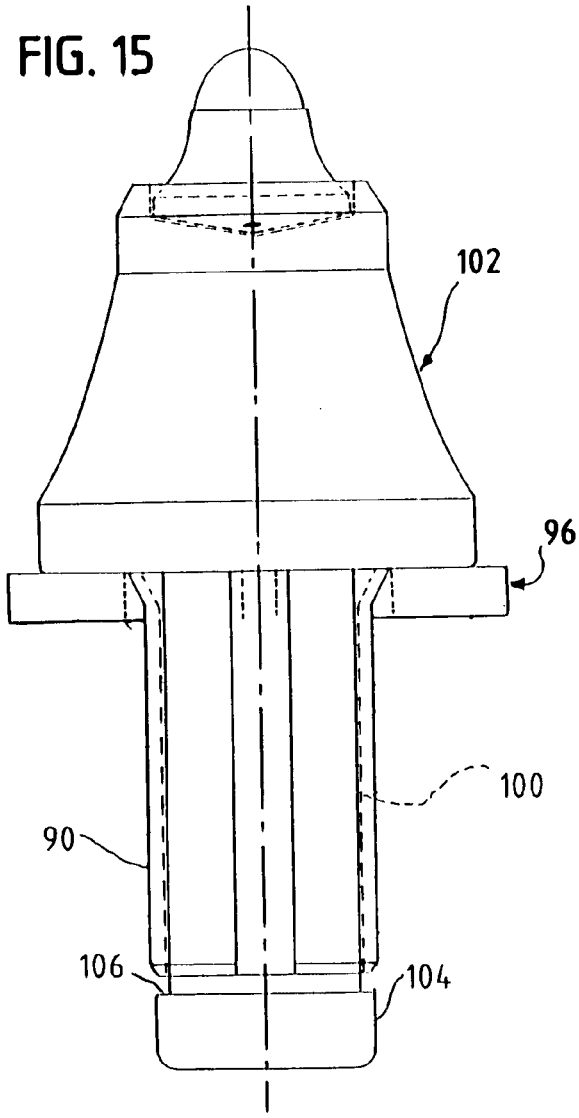

RETAINER SLEEVE AND WEAR RING FOR A ROTATABLE TOOL

The present application relates to rotatable tools used in machines to cut hard surfaces, the tools having a non-rotatable retaining sleeve to retain the tool in a tool holder, and in particular to an improved wear ring positioned between the tool and the tool holder that is engaged to the stationary retaining sleeve so as not to rotate with the tool.

BACKGROUND OF THE INVENTION

Machines for cutting hard surfaces, such as used in the trenching and mining industries and for highway cold planning to remove the upper surface of concrete and asphalt pavement, employ tools fitted into tool holders on a rotating wheel or drum. The tools have a tapered forward cutting end and axially located behind the cutting end is a cylindrical shank that rotatably fits within a complementarily shaped bore in the tool holder. Such rotatable tools have an annular rearwardly directed flange between the forward cutting end and the shank that contacts the forward surface of the tool holder. Force is applied by the tool holder against the radial flange to force the tool into the hard surface to be cut. The shank is retained in the bore of the tool holder by a sleeve made of spring steel so as to be compressible and has an unstressed diameter greater than that of the bore such that the compression of the sleeve retains the sleeve within the bore of the tool holder. To prevent the withdrawal of the tool from the sleeve inwardly directed projections on the inner surface of the sleeve engage one or more annular rings around the circumference of the shank of the tool.

To maximize the useful life of such tools, the tools are adapted to rotate around the axis of the shank thereby causing the tool to wear evenly around its circumference. A tool in a machine may go through 50,000 rotations or more during a single workday. Where the annular rearwardly directed flange of the tool rotates against the forward surface of the tool holder, the rotation of the tool will, over a period of time, cause the forward surface of the tool holder to become worn away. To prevent such wear, it is common to provide an annular wear ring around the shank of the tool between the forward surface of the tool holder and the rearwardly directed flange of the tool.

When the wear ring operates properly, the wear ring remains stationary against the forward surface of the tool holder while the tool rotates against the surface of the wear ring such that only the forward surface of the wear ring becomes worn. Tool rotation occurs because the tool is mounted at an angle of about seven degrees from a plane perpendicular to the axis of rotation of the drum or wheel. As a result of the angle, when the tool impacts against a surface to be cut, there is a component of force applied to the outer surface of the tool that is perpendicular to the axis of rotation. Some of this force is applied to the outer circumference of the wear ring and, as a result, to some degree the wear ring rotates with the tool rather than remaining stationary with the tool holder. When this occurs the wear ring, which is intended to protect the forward end of the tool holder, causes wear to the surface it was intended to protect. It would be desirable, therefore, to provide an improved wear ring that would be locked against rotation with the tool during the operation of the machine.

SUMMARY OF THE INVENTION

Briefly, the present invention is an improved retainer sleeve and an associated wear ring. The device is useable with a tool having a tool body with a tapered forward cutting end with a hardened insert fitted at the forward end of the cutting end of the tool. At the rearward end of the forward cutting end is a rearwardly directed annular flange, and axially behind the annular flange is a axially extending cylindrical shank adapted to rotatably fit within a tubular bore of a tool holder. The tool holder has a generally planar forward surface and between the forward surface of the tool holder and the annular flange of the tool is an annular wear ring. A compressible sleeve is adapted to fit around the circumference of the shank of the tool and within the cylindrical bore of the tool holder to retain the shank of the tool in the tool holder.

In accordance with the present invention, means is provided at the forward end of the compressible sleeve and on the wear ring to prevent the rotation of the wear ring with respect to the sleeve. The engagement between the wear ring and the sleeve prevents rotation of the wear ring with the tool. The wear ring therefore remains stationary with respect to the forward surface of the tool holder and therefore only the forward surface of the wear ring, which is in contact with the rearwardly directed annular flange of the tool, becomes worn during the operation of the machine.

In one embodiment of the invention, the wear ring has a non-circular inner opening that receives a portion of the forward end of the sleeve that is non-circular. The forward end of the sleeve may have a crimping therein so as to have an outer shape complementary to the shape of the inner opening of the wear ring.

In another embodiment of the invention, the forward end of the sleeve has at least one indentation therein and the inner opening of the wear ring is adapted to fit around the sleeve. The wear ring has at least one inwardly directed projection adapted to engage the indentation of the sleeve to prevent rotation of the wear ring with respect to the sleeve.

In another embodiment, the sleeve has an elongate slit along the length thereof that is sized to allow a spacing between the ends of the elongated slit while the sleeve is fitted into the bore of the tool holder and the wear ring has an inwardly directed projection sized to fit between the ends of the sleeving that form the slit to thereby prevent rotation of the wear ring with respect to the sleeve.

One aspect of the invention is that the outer diameter of the wear ring is larger than the outer diameter of the forward end of the tool holder. A removal tool can therefore be used to engage the overhang of the wear ring to remove the tool from the tool holder when the tool is to be replaced.

BRIEF DESCRIPTION OF THE DRAWINGS

A better understanding of the invention will be had after a reading of the following detailed description taken in conjunction with the drawings wherein:

FIG. 2 is a side-elevational view of the sleeve shown in FIG. 1 with the unseen portions thereof shown in broken lines;

FIG. 3 is a front-end elevational view of the sleeve shown in FIG. 2;

FIG. 4 is a plan view of the wear ring for use with the sleeve shown in FIG. 2;

FIG. 5 is an exploded view of the assembled parts including the tool and, the sleeve shown in FIG. 2 and the wear ring shown in FIG. 4 with the parts shown in reduced size;

FIG. 14 is a front elevational view of a wear ring for use with the sleeve shown in FIG. 13; and FIG. 15 is a side-elevational view in reduced size of the sleeve of FIG. 13 and the wear ring of FIG. 14 assembled to a tool with the inner portions of the parts shown in broken lines.

DETAILED DESCRIPTION OF A PREFERRED EMBODIMENT

Figure 1:
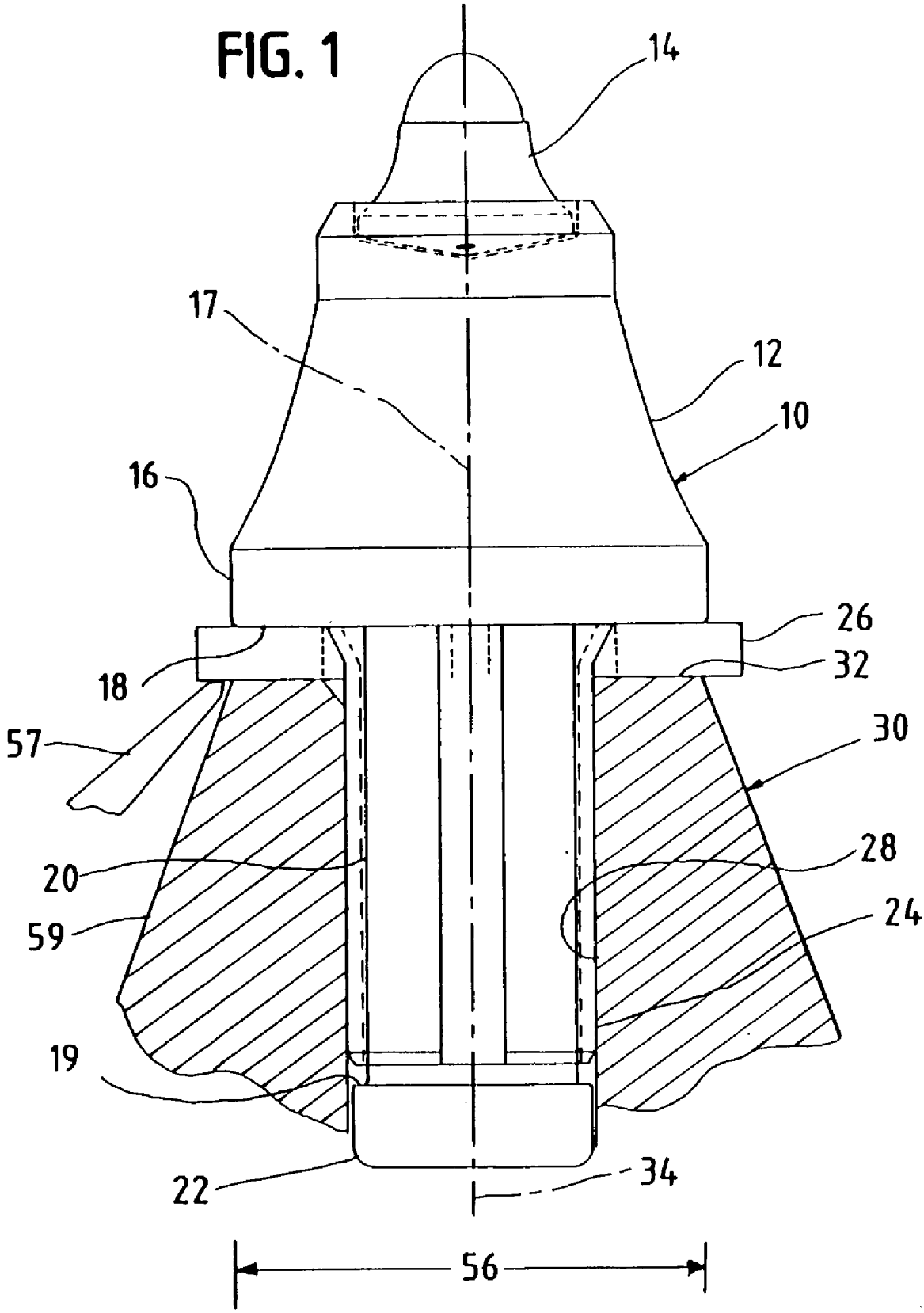
FIG. 1 is a side elevational view of a tool having a sleeve and wear ring in accordance with the present invention fitted in a tool holder with the inner portions of the sleeve and wear ring shown in broken lines and the tool holder shown in cross section, and also showing an extraction tool for removing the tool from the holder.
Figure 6A:
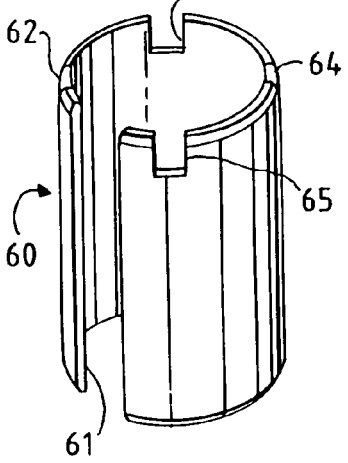
FIG. 6A is an isometric view of the sleeve shown in FIG. 6.
Figure 7:
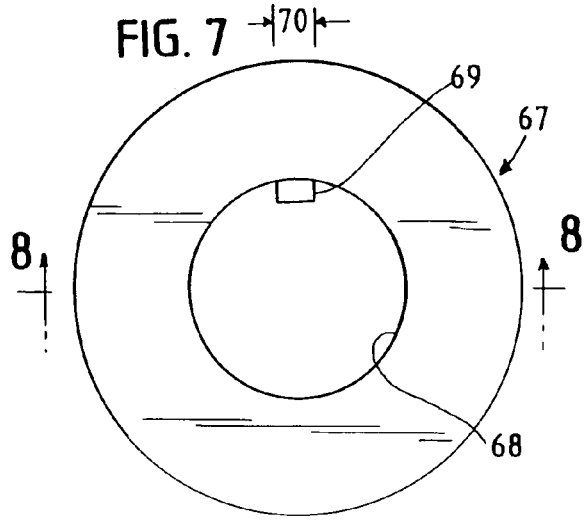
FIG. 7 is a front elevational view of a wear ring in accordance with a second embodiment thereof.
Figure 8:
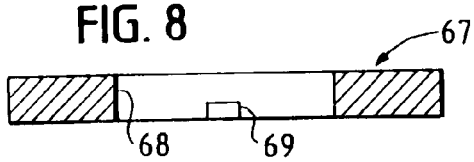
FIG. 8 is a cross-sectional view of the wear ring shown in FIG. 7 taken through line 8—8 thereof.
Figure 6B:
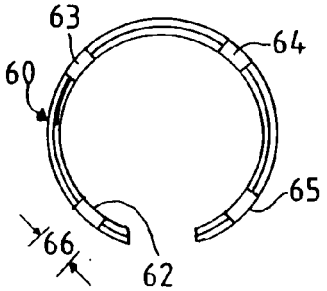
FIG. 6B is a front-elevational view of the sleeve shown in FIG. 6.

Referring to FIGS. 1 through 5, a rotatable tool 10 having a tapered forward cutting end 12 has a hardened insert 14 brazed into a seat at the forward end thereof. The tapered forward cutting end 12 reaches a maximum diameter at the rearward end 16 thereof, with the rear surface defined by an annular rearwardly directed planar surface 18. Extending axially from the center of the rearward surface 18 is a cylindrical shank 20 having an enlarged hub 22 at the distal end thereof with a shoulder 19 between the central portion of the shank 20 and the hub 22. The parts of the tool 10, including the forward cutting end 12, the hardened insert 14, the rearward surface 18, the shank 20 and the hub 22 are symmetric about a longitudinal axis 17.

Fitted around the circumference of the shank 20 is a compressible sleeve 24 made of a suitable spring steel. The sleeve 24 has an elongate slot 21 having spaced apart ends 23, 25 such that the circumference of the sleeve 24 can be compressed. The rearward end of the sleeve 24 engages the annular shoulder 19 on the shank 20 of the tool 10 to retain the sleeve 24 to the shank 20 of the tool 10. At the forward end of the sleeve 24 and adjacent the rearward surface 18 is an annular wear ring 26 that encircles the forward end of the shank 20 and the sleeve 24.

The shank 20 of the rotatable tool 10 and the sleeve 24 are fitted into a bore 28 of a tool holder 30 for retaining the tool 10 to a rotating drum or wheel of a cutting machine, not shown. The shank 20 of the tool 10 is retained within the bore 28 of the tool holder 30 by radially outwardly exerted pressure caused when the compressible sleeve 24 is compressed and fitted into the bore 28. The tool holder 30 is retained to the rotating drum or wheel by suitable means, not shown, and the tool holder 30 has an annular planar forward surface 32 perpendicular to the axis 34 of the bore 28. When the tool 10, the sleeve 24, and the wear ring 26 are assembled to the tool holder 30, the rearward surface 18 of the tool 10 abuts the forward surface of the wear ring 26, and the rearward surface of the wear ring 26 abuts the forward surface 32 of the tool holder 30. When the machine, not shown, is used to cut a hard surface, force is applied through the forward surface 32, and through the surfaces of the wear ring 26 and against the rearward surface 18 of the tool to force the hardened insert 14 into the surface to be cut by the machine.

As the machine cuts a hard surface, the tool 10 is caused to rotate around its longitudinal axis 17 at the same time that strong forces are applied through the forward surface 32 of the tool holder 30. The wear ring 26 is positioned between the forward surface 32 of the tool holder and the rearward surface 18 of the tool 10, and when the wear ring 26 operates properly, it remains stationary with the tool holder 30 while the tool 10 rotates, causing wear to occur between the rearward surface 18 of the tool 10 and the forward surface of the wear ring 26.

Prior to the present invention, the wear ring 26 was free to rotate with the tool 10, thereby causing wear to the forward surface 32 of the tool holder 30. The tools 10 of a machine are mounted on the drum or wheel at an angle of about seven degrees from a plane perpendicular to the axis of rotation. The tool 10 is therefore at an angle to the surface being cut as the drum of the wheel rotates causing force to be applied to the outer surface of the tool. Where the tool has a wear ring, the same forces that cause the tool to rotate are applied to the outer surface of the wear ring unless the diameter of the wear ring is significantly less than that of the flange 16 of the tool 10.

Referring to FIGS. 2 and 3, in accordance with one embodiment of the present invention, to prevent the rotation of the wear ring 26 with the tool 10, the forward end of the sleeve 24 is provided with a plurality of radially outwardly extending projections 38 defining a maximum outer diameter 39. As a result of the projections 38, the forward end of the sleeve is non-circular.

Referring to FIGS. 1, 3, 4, and 5, the wear ring 26 has a central opening 40 defined by a plurality of arcuate portions 42, 43, 44, 45, 46, 47, 48, 49. Arcuate portions 42, 44, 46 and 48 define a first diameter 51 that is larger than the diameter of the shank 20 such that the shank 20 can freely rotate within the first diameter 51. On the other hand, the first diameter 51 is less than the diameter defined by the projections 38 of the sleeve 24, while the sleeve 24 is fitted into the bore 28. Portions 43, 45, 47, and 49 of the central opening 40 define a second diameter 52 that is larger than the diameter 39 defined by the projections 38 of the sleeve. Shoulders 53—53 are positioned between all the adjacent arcuate portions 42–49, and accordingly there are eight shoulders 53—53.

When the parts, including the tool 10, the sleeve 24, and wear ring 26 are assembled together into the tool holder 30, as shown in FIG. 1, the projections 38 of the sleeve 24 will fit within the large diameter portions 43, 45, 47, 49 of the opening 40 of the wear ring 26. Accordingly, the projections 38 will engage the various shoulders 53—53 within the central opening 40 of the wear ring 26, thereby retaining the wear ring 26 from rotating with respect to the sleeve 24. As a result, the forward surface 32 of the tool holder 30 will not become worn as the tool 10 rotates.

Referring further to FIGS. 1 and 4, another aspect of the present invention is that the outer diameter 55 of the wear ring 26 is sufficiently larger that the diameter 56 of the forward end of the tool holder 30 to enable the end of a removal tool 57 to be fitted behind the overhang where the outer end of the wear ring extends beyond the diameter of the tool holder. The tool 57 may then be used to force the tool 10 from the tool holder 30 when the tool is to be replaced.

Referring to FIGS. 1, 6, 6A, 6B, 7, and 8 in a second embodiment of the invention, a sleeve 60 is made of a spring steel and has an elongate slot 61 therein so as to be compressible and fitted within the bore 28 of a tool holder 30. At the forward end of the sleeve 60 are notches 62, 63, 64, 65, each of which has a width 66.

A wear ring 67 for use with the sleeve 60 has an outer diameter that is a little larger than the outer diameter of the rearward end 16 of the cutting end 12 of the tool 10 so as to form an overhang that can be engaged by a removal tool as has been described above. The wear ring 67 also has a central opening 68 with a diameter larger than the diameter of the bore 28 of the tool holder 30. Accordingly, when the sleeve 60 is compressed and fitted into the bore 28 at the forward end of the tool holder, the compressed sleeve 60 will fit freely within the central opening 68 of the wear ring 67.

Extending radially inwardly from the wall of the central opening 68 of the wear ring 67 is a projection 69. The projection 69 has a width 70, defined by the tangent of the arc occupied by the projection 69, that is less than the width 66 of the notches 62–65 in the forward end of the sleeve 60. Accordingly, when the wear ring 67 is fitted on the forward end of a shank 20 and around the forward end of the sleeve 60, the projection 69 fits into one of the notches 62–65 thereby preventing the wear ring 67 from rotating with respect to the sleeve 60.

It should be appreciated that while the sleeve 60 is depicted as having four notches 62–65, the sleeve 60 can be formed with any number of notches as long as at least one notch has a width 66 suitable to accept the projection 69.

Figure 10:
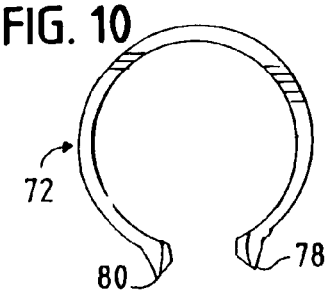
FIG. 10 is a front-elevational view of the sleeve shown in FIG. 9.
Figure 6:
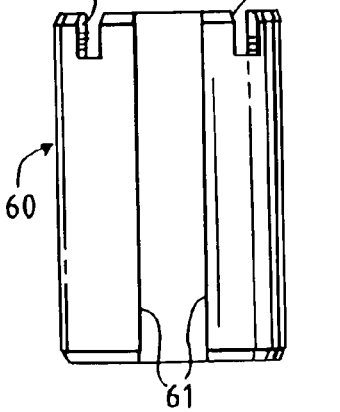
FIG. 6 is a side-elevational view of a second embodiment of a sleeve in accordance with the invention.
Figure 9:
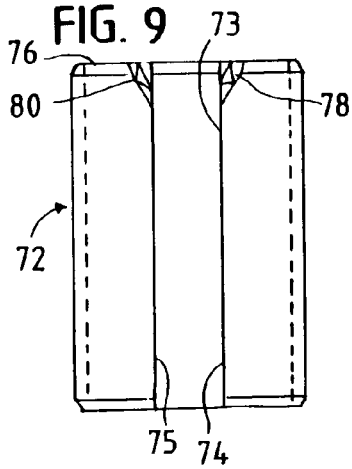
FIG. 9 is a side-elevational view of a sleeve in accordance with a third embodiment of the sleeve of the invention.
Figure 11:
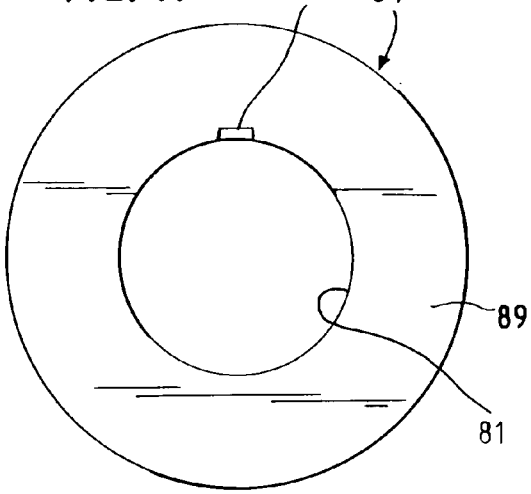
FIG. 11 is a bottom elevational view of a wear ring in accordance with another embodiment of the invention.
Figure 12:
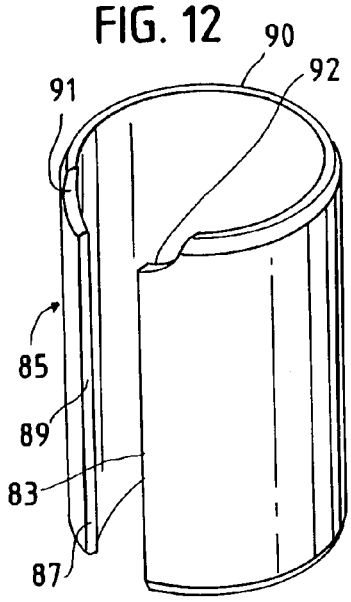
FIG. 12 is an isometric view of a sleeve in accordance with another embodiment of the invention.
Figure 11A:
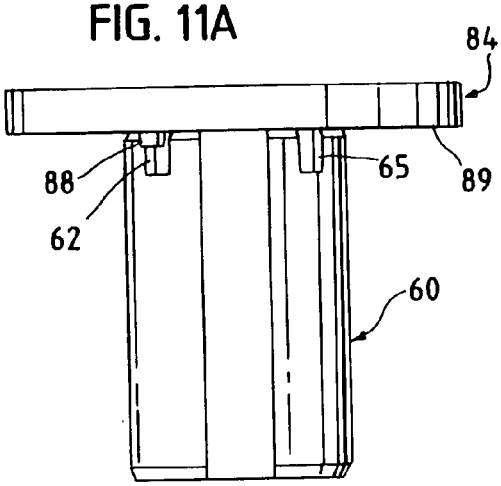
FIG. 11A is a side elevational view of the sleeve shown in FIG. 6 assembled to the wear ring shown in FIG. 11.

Referring to FIGS. 9 and 10, a third embodiment of a sleeve 72 has an elongate slot 73 therein having spaced edges 74, 75. The corners 78, 80 formed by the intersection of the edges 74, 75 and the forward end 76 of the sleeve are folded so as to extend radially outward as depicted. When the sleeve 72 is thereafter compressed and fitted into the bore 28 of the tool holder 30, the corners 78, 80 define a diameter that is greater than that of the bore 28.

The sleeve 72 is usable with the wear ring 26 depicted in FIG. 4. When the forward end 76 of the sleeve 72 is fitted into the central opening 40 of the wear ring 26, the corners 78, 80 of the sleeve will enter into the large second diameter 52 formed by portions 43, 45, 57, 49 of the wear ring 26 and engage the shoulders 53—53 to thereby prevent rotation of the wear ring 26 with respect to the sleeve 72.

It should be appreciated that the wear ring may have any of a number of configurations and fall within the scope of the present invention. Referring to FIGS. 6, 6A, 6B, 11, and 11A, a wear ring 84 has a central opening 81, and a projection 88 positioned adjacent the central opening that extends axially rearwardly of the rearward surface 89 thereof. In this embodiment, the wear ring 84 does not fit around the forward end of the sleeve 60, as was the case with the previously discussed wear rings 26 and 67. The wear ring 84 is useable in conjunction with the sleeve 60. When used with sleeve 60, the axial extension 88 of the wear ring 84 extends into one of the notches 62–65 of the sleeve 60.

It should also be appreciated that the sleeve may also have any of a number of configurations and fall within the spirit of the invention. Referring to FIGS. 7, 8, 11, 11A, and 12, sleeve 85 has an elongate slot 87 through the length thereof and at the intersection of the sides 83, 89 of the slot 87 and at the forward end 90 of the sleeve 85 are cut outs 91, 92. The sleeve 85, a tool 10, and a wear ring, such as wear ring 67 or wear ring 84, can be fitted around the shank 20 of the tool 10. The projection 69, 88 of the wear ring 67, 84 will extend between the cut out portions 91, 92 at the forward end of the sleeve 85.

It should be appreciated that the sleeve 85 could be manufactured with the sides 83, 89 of the slot 87 spaced sufficiently far apart to permit the projections 69, 88 from one of the wear rings 67, 84 to extend between the sides 83, 89 without requiring cut outs such as cut outs 91, 92 shown with respect to the sleeve 85.

The essential elements of all the forgoing embodiment are an indentation or projection on a wear ring 26, 67, 84 that engages a complementary-shaped projection or indentation on a sleeve 24, 60, 72, 85 to thereby prevent rotation of the wear ring 26, 67, 84 with respect to the sleeve when the parts are assembled together.

Figure 13:
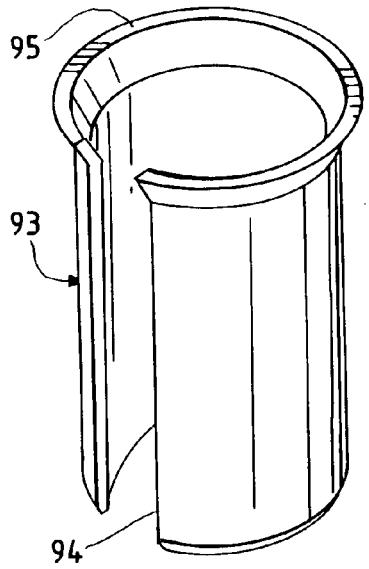
FIG. 13 is an isometric view of a sleeve in accordance with yet another embodiment of the invention.

FIGS. 13 through 15 disclose a somewhat different embodiment of the invention in which a sleeve 93 has a generally cylindrical body with an elongate slot 94 and a radially outwardly directed flare 95 at the forward end thereof. The wear ring 96 for use with the sleeve 93 has an annular body with planar, forward and rearward surfaces, and a cylindrical central opening 98. When the sleeve 93 is fitted around the shank 100 of a tool 102 having a retaining hub 104 at the distal end thereof, a shoulder 106 at the forward end of the hub 104 retains the sleeve 93 on the shank 100. The sleeve 93 is compressed within the bore of the tool holder, not shown, and the radially outwardly directed forces of the sleeve 93 against the inner wall of the tool holder prevents the sleeve 93 from rotating with the tool. The flare 95 of the sleeve 93 contacts the central opening 98 of the wear ring 96, and the resistance caused by the contact of the flared surface 95 against the inner opening 98 of the wear ring 96 is sufficient to prevent the wear ring 96 from rotating.

While the invention has been described with respect to several embodiments, it will be appreciated that there are many other configurations and embodiments which would fall within the true spirit and scope of the invention. It is therefore the intent of the appended claims to cover all such modifications and variations which fall within the spirit and scope of the invention.

What is claimed:

1. A tool comprising a tool body having a tapered cutting end, a hardened tip at a forward end of said cutting end, an axial shank extending rearward of said forward cutting end and a radial flange joining said axial shank to said forward cutting end, a compressible sleeve around said shank, said compressible sleeve having a forward end, said forward end having at least one radially outwardly extending protrusion wherein said forward end is non-circular, a wear ring having a noncircular central opening complementary to said noncircular forward end of said compressible sleeve and including a radially extending contact surface, said central opening extending around said forward end of said sleeve, and around said shank wherein said protrusion contacts said contact surface of said central opening and prevents rotation of said wear ring relative to said sleeve.

2. The tool of claim 1 wherein said central opening has a first arcuate portion defining a first circle with a first radius, a second arcuate portion defining a second circle with a second radius less than said first radius, and said contact surface extending between said first arcuate portion and said second arcuate portion.

3. In a tool having a tool body with a tapered forward cutting end, an axial shank extending rearwardly of said forward cutting end, and a rearwardly facing annular surface joining a rearward end of said forward cutting end to a forward end of said shank, a compressible sleeve around said shank, and a wear ring around said shank adjacent said annular surface, the improvement comprising said compressible sleeve having a forward end and a radial projection extending only from said forward end wherein said forward end is noncircular, said wear ring having a central opening, said central opening being noncircular and extending around a circumference of said forward end of said sleeve wherein a radially extending surface of said noncircular central opening contacts said projection for locking said wear ring to said sleeve wherein said wear ring cannot rotate with respect to said sleeve.

4. The tool of claim 3 wherein said central opening has a first arcuate portion defining a circle with a first radius and a second arcuate portion defining a circle with a second radius less than said first radius, and said radially extending surface extends between said first arcuate portion and said second arcuate portion.

5. The improvement of claim 3 wherein said forward end of said sleeve has a plurality of radially outwardly extending projections, and said central opening has a plurality of radially extending surfaces that contact said plurality of projections.

6. A rotatable tool comprising a tool body having a tapered cutting end, a hardened tip at a forward end of said cutting end, an axial shank extending rearward of said forward cutting end and a radial flange joining said axial shank to said forward cutting end, a compressible sleeve around said shank, a wear ring around said shank and adjacent of said radial flange, said compressible sleeve having a forward end, said forward end of said compressible sleeve having a radially outwardly extending projection wherein said forward end is non-circular, and said wear ring having a non-circular central opening for receiving said non-circular forward end of said sleeve wherein said projection on said compressible sleeve will contact a radially extending surface of said non-circular central opening and prevent rotation of said wear ring with respect to said sleeve.

7. The tool of claim 6, wherein said forward end of said compressible sleeve has a plurality of radially outwardly extending projections.

8. The tool of claim 7 wherein said central opening of said wear ring has a plurality of radial surfaces for contacting said plurality of projections.

9. A tool for use in a tool holder having a cylindrical bore and a forward surface, said tool comprising a tool body having a tapered forward cutting end, an axial shank extending rearwardly of said forward cutting end, and a rearwardly facing annular surface joining a rearward end of said forward cutting end to a forward end of said shank, a compressible sleeve around said shank for retaining said shank in said bore of said tool holder, an annular wear ring around said compressible sleeve, said compressible sleeve having a forward end, said forward end of said compressible sleeve having a radially outwardly extending projection wherein said forward end is non-circular, and said wear ring having a non-circular central opening for receiving said non-circular forward end of said sleeve wherein said projection on said compressible sleeve will contact a radially extending surface of said non-circular central opening and prevent rotation of said wear ring with respect to said sleeve.

10. The tool of claim 9 wherein said forward end of said compressible sleeve has a plurality of radially outwardly extending projections.

11. The tool of claim 10 wherein said central opening of said wear ring has a plurality of radially extending surfaces for contacting said plurality of projections.

12. The tool of claim 9 wherein said non-circular opening comprises a first arcuate portion defining a diameter a little larger than a diameter of said cylindrical bore, and a second arcuate portion defining a diameter larger than said diameter defined by said first arcuate portion, wherein said second arcuate portion receives a radially outwardly extending projection of said annular wear ring to prevent said wear ring from rotating with respect to said sleeve.

* * * * *